United States Patent [19]

Pluim

[11] 4,304,288

[45] * Dec. 8, 1981

[54] LINEAR PERMANENT MOULD CASTING SYSTEM

[75] Inventor: Cornelius Pluim, Puslivch, Canada

[73] Assignee: Cast-Tec Ltd., Oakville, Canada

[ * ] Notice: The portion of the term of this patent subsequent to Apr. 29, 1997, has been disclaimed.

[21] Appl. No.: 70,763

[22] Filed: Aug. 30, 1979

Related U.S. Application Data

[63] Continuation-in-part of Ser. No. 971,760, Dec. 21, 1978, Pat. No. 4,200,139.

[51] Int. Cl.[3] ..... B22D 29/00; B22D 47/00

[52] U.S. Cl. ..... 164/72; 164/269; 164/323

[58] Field of Search ..... 164/72, 130, 267, 269, 164/270, 322, 323, 324, 340

[56] References Cited

U.S. PATENT DOCUMENTS

| | | | |
|---|---|---|---|
| 1,033,254 | 7/1912 | Lister | 164/130 X |
| 1,319,673 | 10/1919 | Stephenson | 164/269 X |
| 1,622,875 | 3/1927 | Lee | 164/72 X |
| 1,635,369 | 7/1927 | Lee | 164/267 |
| 4,186,793 | 2/1980 | Teplinsky et al. | 164/324 X |
| 4,200,139 | 4/1980 | Pluim | 164/72 |

FOREIGN PATENT DOCUMENTS

| | | | |
|---|---|---|---|
| 441101 | 6/1975 | U.S.S.R. | 164/324 |

*Primary Examiner*—Robert L. Spruill
*Assistant Examiner*—J. Reed Batten, Jr.
*Attorney, Agent, or Firm*—Beveridge, DeGrandi & Kline

[57] ABSTRACT

A process relating to the pouring of molten metal into a permanent mould made of iron or other like material, automating the moulds within the system so as to offer diversification of production and while so doing having a finished product that is of a machinable and marketable nature. Slow cooling of the castings through the critical temperature in the system limits the formation of iron carbides and successfully produces a machinable product.

5 Claims, 4 Drawing Figures

Figure 1A:
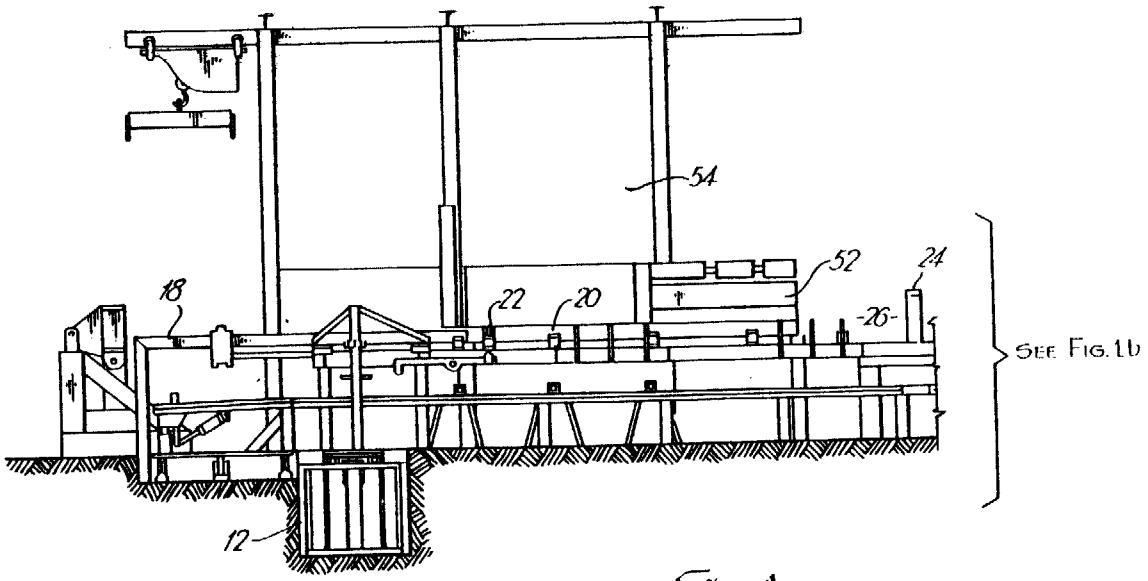

SEE FIG 2b 50
49
52
54
56
18
22
20
26
24
28
12

LINEAR PERMANENT MOULD CASTING SYSTEM

This application is a continuation-in-part of application Ser. No. 971,760 filed Dec. 21, 1978 and now U.S. Pat. No. 4,200,139 issued Apr. 29, 1980.

This invention relates to a linear, permanent mould casting system and method of casting. The system according to the present invention may produce up to twenty-five different castings simultaneously and does not require as noisy and dirty a casting shakeout system as conventional sand moulding, vastly improving foundry working conditions. A casting yield of a permanent mould process in accordance with the present invention is approximately ninety percent compared with seventy-five percent for an automatic sand molding system. At a two million B.T.U. per ton energy requirement, permanent mould casting in accordance with the present invention is seventeen percent more efficient.

In a permanent mould system according to the present invention the mould walls are rigid and inert which not only improves casting yield but improves surface finish and dimensional control. Tolerances of plus or minus one sixty-fourth of an inch are possible which can reduce secondary machining considerably or in some cases even eliminate the operation.

There are disadvantages of known forms of permanent mould castings and in particular due to a rapid cooling rate, permanent mould castings are subject to chilling or the formation of iron carbides. This greatly reduces casting machinability. Additionally, permanent mould dies are expensive and have a definite life span.

The present invention provides great improvements over known systems in the provision of a casting machine or system which transports the permanent moulds through core setting, pouring and knockout stations. This reduces manpower costs substantially and also provides a reduction of in-plant pollutants which then are concentrated in one area and can be cleaned efficiently.

By pouring the castings in a designated area the molten metal can be innoculated just prior to pouring. Due to the fading effect of additives (magnesium, ferro-silicon, etc.) the molten metal should be treated just prior to pouring which is only possible if the process utilizes a central pouring station in accordance with the present invention.

Permanent mould castings can be control-cooled according to the present invention by being held at 1700° F. to 1800° F. for a short period of time (approximately fifteen minutes) immediately after solidification. This provides sufficient time to allow graphitization or reduction of chill to occur and yet the short holding time prevents warpage. An added advantage of this softening method is a substantial saving in energy in not having to bring the casting up to temperature and hold it there for several hours as is the case in the prior art. This method utilizes the removal of castings from the permanent moulds at a centralized location and with the option of feeding the castings directly into a controlled cooling facility if desired.

In accordance with a broad aspect, the invention relates to a linear, permanent mould casting system having means for indexing and moving each of a plurality of moulds linearly through a plurality of stations and comprising in series: (a) a casting station for coating each said mould; (b) a core setting station for setting cores when required; (c) a time reading station reading a solidification time from the mould and registering said solidification time into a memory system so as to control the opening of said moulds; (d) a clamping station for securing each of said moulds in a closed position; (e) a pouring station for filling said moulds; (f) a plurality of cooling and unclamping stations controlled in accordance with the solidification time registered in the memory system for opening said moulds and for releasing castings, therefrom and (g) a shuttle for transferring each mould to one end of a return track, means for conveying each mould along the return track, and a second shuttle for transferring each mould from the other end of the return track to the coating station.

In accordance with another broad aspect the invention relates to a process of producing castings in a permanent mould comprising the steps of (1) coating a mould at a coating station with a suitable coating, (2) forwarding said mould to a core setting station and closing said mould, (3) indexing said mould to a time reading station and recording solidification time on said mould and registering said time into a memory, (4) moving said mould to a clamping station and clamping said mould in a closed position, (5) indexing said mould to a pour station and filling said mould with the molten metal and starting said solidification timing, (6) moving said mould into solidification stations, and (7) unlatching said mould and ejecting said casting onto a conveyor.

Figure 1B:
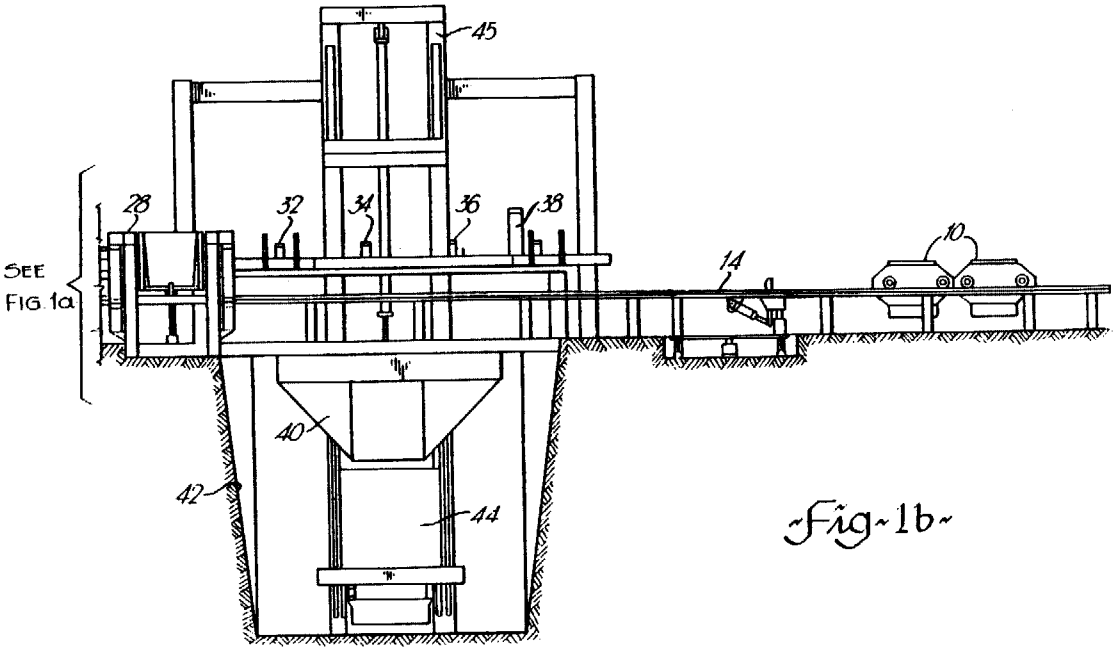
Figure 2A:
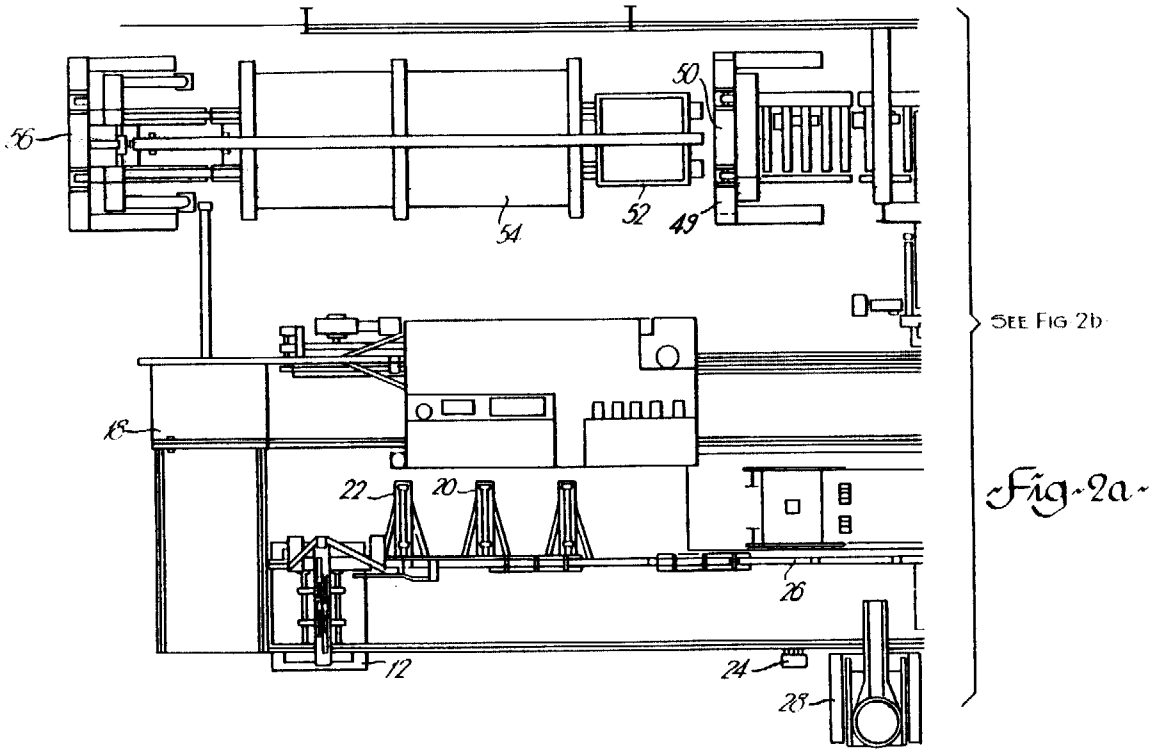
Figure 2B:
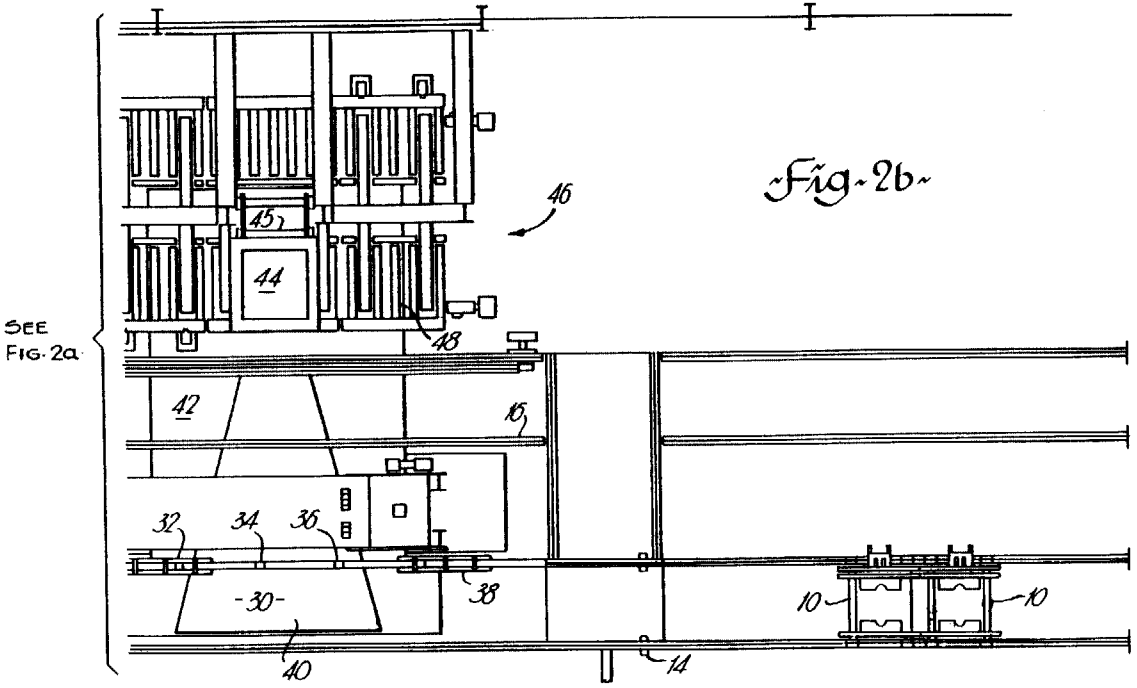

The invention is illustrated by way of example in the accompanying drawings in which:

FIGS. 1*a* and 1*b* illustrate an elevation view of the linear permanent mould casting system according to the invention; and FIGS. 2*a* and 2*b* illustrate a plan view of the system shown in FIGS. 1 and 1*a*.

Referring to the drawing, the system incorporates a plurality of mould holding units 10 shown at the right hand end of the drawing and mould holding units 10 are conveyed through a linear circuit beginning at a coating station 12 through to a shuttle station 14 where they are moved to a return track 16 and thence to another shuttle 18 to return to the coating station 12. With a mould holding unit 10 at the coating station, the mould is coated with a desirable coating such as acetylene smoke and is moved by an indexing mechanism 20 to a core setting station 22 where if required a core is placed in the mould and the mould is closed. The mould holding unit 10 is then indexed until it reaches a time reading station 24 where a solidification time is taken on the mould 10 and registered into a memory. The mould holding unit 10 is then indexed into a clamping station 26 where the mould is closed such as by clamping cylinders (not shown) which are latched onto the mould or by other suitable means to hold it in a closed position. The mould holding unit is then indexed to a pour station 28 where after the start of pouring molten metal into the mould holding unit, a timing mechanism is initiated. After the mould is filled, the mould holding unit 10 is indexed out therefrom and into a solidification section 30 where the casting is given sufficient time to cool so that the metal is solidified. Depending upon the timing, moulds 10 will open at the first, second or third station 32, 34 or 36 and the casting will be ejected. The mould holding unit continues to the unclamping or unlatching station 38 while the casting is dropped onto a conveyor 40 located in a pit 42 below the system to move the ejected castings and core sand quickly into a container 44 placed at the discharge end. If required, the container and castings therein may proceed through a closed loop transport system indicated generally at 46. This system includes roller conveyor tracks 48, hydraulic cylinder and an elevator 45 for indexing a plurality of containers such as 44 which are insulated and refractory lined with a firing lid for castings that require slow cooling. A heating system (not shown) when required consists of a plurality of burners mounted on stands for preheating the insulated containers before the castings are loaded into the container. One of these burners is required throughout the casting cycle to reheat the empty container prior to it being moved to the loading position to replace the heat loss through the container walls.

The container progresses to a hot casting dump mechanism 49 including a dumping frame 50 for transferring castings from the insulated container into a further container 52 which is then transported through a tunnel 54 equipped with doors at either end and having wheeled containers hydraulically indexed on rails between the dumping frames. Tunnel 54 will provide desired conditions for either rapid cooling or additional annealing and cooling cycles. The second dumping frame 56 is provided to transfer the cooled castings from the exit end of the tunnel 54 into a separation device (not shown) comprising a vibrating conveyor with screen and receiving hopper into which is dumped the containers of castings and core sand. Sand falling through the screen is removed by an inclined belt conveyor while the castings and sprue are discharged from the end to an apron conveyor for sorting and if necessary, further processing.

After the mould holding units are opened they are indexed into the shuttle 14, shuttled across and dumped onto the back track 16 and are then taken by power to the other end of the system where they are indexed into the shuttle 18 and moved across and dumped into the coating station again.

The number of mould holding units in the system can be varied to provide control of the mould temperature cycle.

While the invention has been described in connection with a specific embodiment therein and a specific use, various modifications thereof will occur to those skilled in the art without departing from the spirit and scope of the invention as set forth in the appended claims.

The terms and expressions which have been employed in this specification are used as terms of description and not of limitation and there is no intention in the use of such terms and expressions to exclude any equivalents of the features shown and described or portions thereof, but it is recognized that various modifications are possible within the scope of the invention claimed.

I claim:

1. A process of producing castings in a linear permanent mould casting system comprising the steps of:

coating each of a plurality of moulds at a coating station with a suitable coating, forwarding each of said moulds to a core setting station, and closing said moulds, indexing each of said moulds to a time reading station and recording solidification time on said moulds and registering said time into a memory system, moving each of said moulds to a clamping station and clamping said moulds in a closed position, indexing said moulds to a pour station and filling said moulds with molten metal and starting said solidification timing, moving said moulds into solidification stations;

unlatching and opening said moulds in accordance with the solidification time registered in the memory system and ejecting said castings onto a conveyor.

2. A process according to claim 1 including the further steps of:

moving a plurality of insulated containers to a heating system and preheating said containers for receiving said castings, conveying said castings into said insulated containers placed at the discharge end of said conveyor, control-cooling said castings in a cooling tunnel, and dumping said castings from the insulated containers into cooling containers and at the other end of said tunnel dumping said castings from the cooling containers.

3. A process according to claim 2 including the further step of:

separating said castings from core sand and sprue.

4. A linear, permanent mould casting system having means for indexing and moving each of a plurality of moulds linearly through a plurality of stations and comprising in series:

(a) a coating station for coating each of said moulds;

(b) a core setting station for setting cores when required;

(c) a time reading station reading a solidification time from each of the moulds and registering said solidification time into a memory system so as to control the opening of said moulds;

(d) a clamping station for securing each of said moulds in a closed position;

(e) a pouring station with means for filling said moulds;

(f) a plurality of cooling and unclamping stations controlled in accordance with the solidification time registered in the memory system for opening said moulds and for releasing castings therefrom; and (g) a shuttle for transferring each of said moulds to one end of a return track, means for conveying each of said moulds along the return track, and a second shuttle for transferring each of said moulds from the other end of the return track to the coating station.

5. A casting system according to claim 4 and further comprising:

a closed loop transport system with means for indexing a plurality of containers for receiving castings which require controlled cooling, said containers being insulated and refractory lined and having a firing lid, a heating system with means for preheating the containers of the closed loop transport system, means for receiving the castings from the moulds and delivering them into the said containers, and a cooling tunnel adjacent said transport system having doors at each end for entrance and exit of castings, a first dumping frame for transferring castings from the said containers into cooling containers for transport through the cooling tunnel, and a second dumping frame to transfer cooled castings from the exit end of the tunnel into a separation device for separating sand and castings.

* * * * *